US008421370B2

(12) United States Patent
Kim

(10) Patent No.: US 8,421,370 B2
(45) Date of Patent: Apr. 16, 2013

(54) APPARATUS FOR DRIVING A LIGHT EMITTING DIODE

(75) Inventor: Chee-Young Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 325 days.

(21) Appl. No.: 12/741,305

(22) PCT Filed: Feb. 5, 2008

(86) PCT No.: PCT/KR2008/000713

§ 371 (c)(1),
(2), (4) Date: Sep. 13, 2010

(87) PCT Pub. No.: WO2009/061028

PCT Pub. Date: May 14, 2009

(65) Prior Publication Data

US 2011/0012520 A1 Jan. 20, 2011

(30) Foreign Application Priority Data

Nov. 5, 2007 (KR) ..... 10-2007-0112349

(51) Int. Cl.
*H05B 37/02* (2006.01)

(52) U.S. Cl.
USPC ..... 315/291; 315/185 R; 315/302; 315/309

(58) Field of Classification Search ..... 315/185 R, 315/291, 302, 309
See application file for complete search history.

(56) References Cited

U.S. PATENT DOCUMENTS

| | | | | |
|---|---|---|---|---|
| 7,202,608 | B2 * | 4/2007 | Robinson et al. | 315/224 |
| 7,528,553 | B2 * | 5/2009 | Ito et al. | 315/291 |
| 7,902,771 | B2 * | 3/2011 | Shteynberg et al. | 315/307 |
| 2007/0120496 | A1 | 5/2007 | Shimizu et al. | |
| 2007/0285031 | A1 * | 12/2007 | Shteynberg et al. | 315/294 |

FOREIGN PATENT DOCUMENTS

| | | | |
|---|---|---|---|
| JP | 05-235448 | A | 9/1993 |
| KR | 10-2006-0056348 | A | 5/2006 |
| KR | 10-2007-0074077 | A | 7/2007 |
| WO | WO 00/01046 | A1 | 1/2000 |

* cited by examiner

*Primary Examiner* — Thuy Vinh Tran
(74) *Attorney, Agent, or Firm* — Birch, Stewart, Kolasch & Birch, LLP

(57) ABSTRACT

An apparatus for driving a light emitting diode (LED) comprises: an LED unit configured as a plurality of LEDs are serially connected to each other; a rated current providing unit connected to one end of the LED unit, for providing a current to the LED unit under control of a controller; a voltage dividing unit connected between another end of the LED unit and another end of the rated current providing unit; and a voltage measuring unit connected to the LED unit in parallel, for measuring a voltage applied to the LED unit.

10 Claims, 1 Drawing Sheet

APPARATUS FOR DRIVING A LIGHT EMITTING DIODE

TECHNICAL FIELD

The present invention relates to a light emitting diode, and more particularly, to an apparatus for driving a light emitting diode.

BACKGROUND ART

Generally, voltage divider resistors are serially connected to a plurality of light emitting diodes (LED) on a circuit to which the LEDs are connected. Accordingly, a rated voltage and a rated current are applied to the LEDs and the voltage divider resistors.

DISCLOSURE OF INVENTION

Technical Problem

However, the conventional circuit may cause the following problems. When some of the plurality of LEDs to which the voltage divider resistors are serially connected are short-circuited due to deterioration or aging, an amount of current applied to the voltage divider resistors and the LEDs is increased. Accordingly, components are overheated to be damaged or lost due to burning, and fire may occur.

Technical Solution

Therefore, it is an object of the present invention to provide an apparatus for driving a light emitting diode (LED) capable of stably applying a current or a voltage to an LED.

It is another object of the present invention to provide an apparatus for driving a light emitting diode (LED) capable of controlling an amount of current applied to an LED based on a voltage applied to the LED.

To achieve these objects, there is provided an apparatus for driving a light emitting diode (LED), comprising: an LED unit configured as a plurality of LEDs are serially connected to each other; a rated current providing unit connected to one end of the LED unit, for providing a current to the LED unit under control of a controller; a voltage dividing unit connected between another end of the LED unit and another end of the rated current providing unit; and a voltage measuring unit connected to the LED unit in parallel, for measuring a voltage applied to the LED unit.

According to another aspect of the present invention, there is provided an apparatus for driving a light emitting diode (LED), comprising: a rated current providing unit for controlling an amount of current applied to an LED unit under control of a controller; a voltage dividing unit connected between the LED unit and the rated current providing unit, for dividing a voltage; and a voltage measuring unit connected to the LED unit in parallel, for measuring a voltage applied to the LED unit.

According to still another aspect of the present invention, there is provided an apparatus for driving a light emitting diode (LED), comprising: an LED unit configured as a plurality of LEDs are serially connected to each other; a rated current providing unit connected to one end of the LED unit, for providing a current to the LED unit; a voltage dividing unit connected between another end of the LED unit and another end of the rated current providing unit; a voltage measuring unit connected to the LED unit in parallel, for measuring a voltage applied to the LED unit; and a controller for controlling an amount of current applied to the LED unit by adjusting an amount of current outputted from the rated current providing unit based on a voltage measured by the voltage measuring unit.

MODE FOR THE INVENTION

Reference will now be made in detail to the preferred embodiments of the present invention, examples of which are illustrated in the accompanying drawings.

Hereinafter, an apparatus for driving a light emitting diode (LED) according to the present invention will be explained in more detail with reference to FIGS. 1 and 2.

Figure 1:
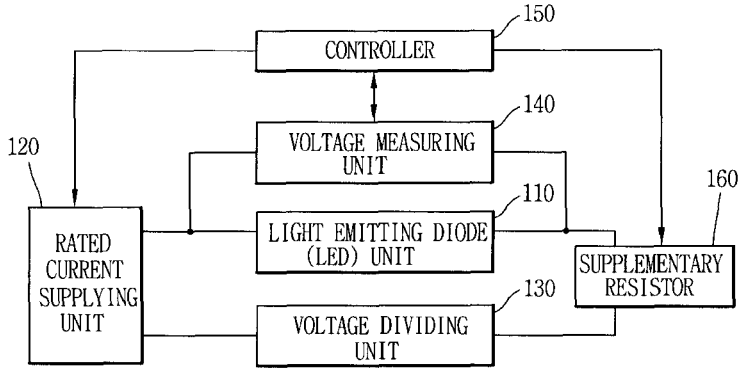
FIG. 1 is a configuration view of an apparatus for driving a light emitting diode (LED) according to a first embodiment of the present invention.

FIG. 1 is a configuration view of an apparatus for driving a light emitting diode (LED) according to a first embodiment of the present invention.

As shown in FIG. 1, an apparatus for driving a light emitting diode (LED) according to the present invention comprises an LED unit 110 configured as a plurality of LEDs are serially connected to each other; a rated current providing unit 120 connected to one end of the LED unit 110, for providing a current to the LED unit; a voltage dividing unit 130 connected between another end of the LED unit 110 and another end of the rated current providing unit 120; a voltage measuring unit 140 connected to the LED unit 110 in parallel, for measuring a voltage applied to the LED unit; and a controller 150 for controlling an amount of current applied to the LED unit 110 by adjusting an amount of current outputted from the rated current providing unit 120 based on a voltage measured by the voltage measuring unit 140.

The apparatus for driving a light emitting diode (LED) according to the present invention may further comprise a supplementary resistor 160 for dividing a voltage applied to the LED unit 110.

The supplementary resistor 160 is configured to serially connect another end of the LED unit 110 and the voltage dividing unit 130 with each other.

Preferably, the supplementary resistor 160 is implemented as a variable resistor having a resistance value varied under control of the controller 150. Here, the resistance value of the supplementary resistor 160 is set so as to be variable under control of the controller 150.

The resistance value of the supplementary resistor 160 may be set as an arbitrary value by a user based on a voltage measured by the voltage measuring unit 140.

The LED unit 110 operates a plurality of LEDs of the LED unit 110 by a current applied from the rated current providing unit 120.

The LED unit 110 may be configured so that a plurality of LEDs can be connected to each other in parallel. In the parallel configuration, a current applied from the rated current providing unit 120 is divided.

For instance, when a current of i[A] is supplied from the rated current providing unit 120 and four LEDs are connected to each other in parallel, a current of i/4[A] is supplied to each of the plurality of diodes.

The rated current providing unit 120 generates a rated current corresponding to a control signal from the controller 150, and provides the generated rated current to the LED unit 110.

The voltage dividing unit 130 is serially connected to the LED unit 110, thereby dividing a voltage applied to the entire circuit. The supplementary resistor 160 may be serially connected between the voltage dividing unit 130 and the LED unit 110, thereby receiving a part of a voltage applied to the entire circuit and dividing it.

Preferably, the voltage dividing unit 130 is configured to be adjacent to the LED unit 110 so as to be influenced by a temperature characteristic of the LED unit 110.

Preferably, the voltage dividing unit 130 is configured as a Positive Temperature Coefficient (PTC) thermistor. The PTC thermistor varies an amount of current applied to the entire circuit according to temperature change. When an amount of current applied to the LED unit 110 is within a rated current, the PTC thermistor maintains a preset divided resistance. On the contrary, when the plurality of LEDs 110 are partially short-circuited due to deterioration or aging, a resistance applied to the entire circuit is decreased to increase an amount of current applied to the entire circuit. When a temperature of the LED unit 110 is detected to increase by the PTC thermistor, the PTC thermistor increases its resistance so that an amount of current applied to the LED unit 110 can be maintained within a range of a rated current error, or cuts off the current applied to the LED unit 110 by its specific characteristic, thereby preventing damage of components and fire occurrence.

The voltage measuring unit 140 is connected to the LED Unit 110 in parallel, thereby measuring a voltage applied to each of the plurality of LEDs of the LED unit 110.

The voltage measuring unit 140 is connected to the LED Unit 110 in parallel, thereby measuring a voltage applied to the LED unit 110.

The controller 150 judges whether the plurality of LEDs are electrically short-circuited due to deterioration or aging, based on a voltage applied to each of the plurality of LEDs and measured by the voltage measuring unit 140, or based on a voltage applied to the LED unit 110 and measured by the voltage measuring unit 140.

More concretely, when each measured voltage of the plurality of LEDs is within a preset error for a value obtained by multiplying a current from the rated current providing unit 120 with an inner resistance of the LED, the controller 150 judges that the corresponding LED is normally operated. Likewise, when a measured voltage of the LED is within a preset error for a value obtained by multiplying a current from the rated current providing unit 120 with an inner resistance of the LED, the controller 150 judges that the corresponding LED is normally operated. For instance, when a measured voltage of the LED unit 110 is 10V, a voltage obtained by multiplying a current from the rated current providing unit 120 with an inner resistance of the LED is 10.2V, and a preset error range is ±5%, a measured voltage of the LED unit 110 is within a range of 9.89V-10.91V at which the error range ±5% is reflected. Accordingly, the controller 150 judges that the LED unit 110 is normally operated. While the LED unit 110 is normally operated, the controller 150 outputs a first control signal to the rated current providing unit 120 so that a constant amount of current can be outputted from the rated current providing unit 120.

When each measured voltage of the plurality of LEDs is smaller or larger than a preset error for a value obtained by multiplying a current from the rated current providing unit 120 with an inner resistance of the LED, the controller 150 judges that the corresponding LED is in a deteriorated or short-circuited state, or has an over-current flowing thereon. When a measured voltage of the LED unit is smaller or larger than a preset error for a value obtained by multiplying a current from the rated current providing unit 120 with an inner resistance of the LED, the controller 150 judges that the corresponding LED is in a deteriorated or short-circuited state, or has an over-current flowing thereon. For instance, when a measured voltage of the LED unit 110 is 11.6V, a voltage obtained by multiplying a current from the rated current providing unit 120 with an inner resistance of the LED is 10.2V, and a preset error range is ±5%, a measured voltage of the LED unit 110 is not within a range of 9.89V~10.91V at which the error range ±5% is reflected. Accordingly, the controller 150 judges that the LED unit 110 is in a deteriorated or short-circuited state, or has an over-current flowing thereon. While the LED unit 110 is in a deteriorated or short-circuited state, or has an over-current flowing thereon, the controller 150 outputs a second control signal to the rated current providing unit 120 so that a rated current can be applied to the LED unit 110. Then, the rated current providing unit 120 generates a current based on the outputted second control signal, and provides the generated current to the LED unit 110.

The controller 150 controls the rated current providing unit 120 so that an amount of current applied to the LED unit 110 from the rated current providing unit 120 can be adjusted, based on a voltage applied to each of the LEDs and measured by the voltage measuring unit 140.

A rated voltage providing unit (not shown) may be implemented instead of the rated current providing unit (120). In this case, the entire configuration of the rated voltage providing unit may be modified by those skilled in the art.

Figure 2:
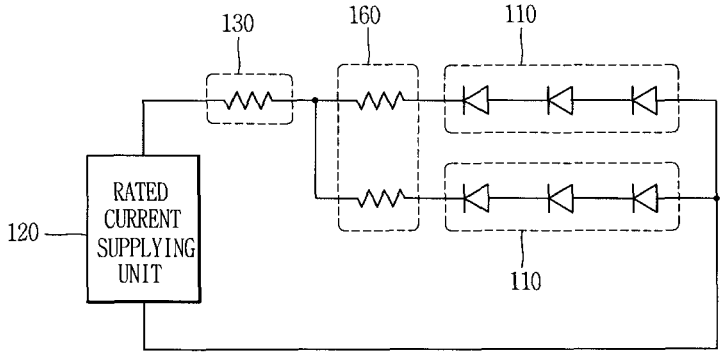
FIG. 2 is a circuit diagram of the apparatus for driving a light emitting diode (LED) according to the first embodiment of the present invention.

FIG. 2 is a circuit diagram of the apparatus for driving a light emitting diode (LED) according to the first embodiment of the present invention.

As shown, the apparatus for driving a light emitting diode (LED) according to the present invention comprises an LED unit 110 configured as a plurality of LEDs are serially connected to each other; a rated current providing unit 120 connected to one end of the LED unit 110; and a voltage dividing unit 130 connected between another end of the LED unit 110 and another end of the rated current providing unit 120.

The apparatus for driving a light emitting diode (LED) according to the present invention may further comprise a supplementary resistor 160 serially connected between another end of the LED unit 110 and another end of the voltage dividing unit 130.

As shown in FIG. 2, the LED unit 110 may be configured so that a plurality of LEDs can be connected to each other in parallel. In the parallel configuration, a current supplied from the rated current providing unit 120 is divided.

Preferably, the voltage dividing unit 130 is configured as a Positive Temperature Coefficient (PTC) thermistor. When an amount of current applied to the LED unit 110 from the rated current providing unit 120 is within a range of a rated current error, the PTC thermistor maintains its inner resistance to be small. On the contrary, when an inner temperature of the LED unit 110 increases due to deterioration or aging, an inner resistance of the PTC thermistor increases thus to decrease or cut-off a current applied to the LED unit 110.

The apparatus for driving a light emitting diode (LED) according to the present invention may further comprise a controller 160 for measuring a voltage applied to the LED unit 110 by the voltage measuring unit 140, and controlling an amount of current outputted from the rated current providing unit 120 based on the measured voltage.

INDUSTRIAL APPLICABILITY

The apparatus for driving an LED according to the present invention has the following effects.

First, a current or a voltage is stably applied to LEDs, thereby preventing the LEDs from being mal-operated.

Second, a current or a voltage is stably applied to the LEDs, thereby preventing the components from being damaged or lost, and reducing the fabrication cost.

Third, an amount of current applied to the LEDs is adjusted based on a voltage applied to the LEDs, thereby preventing the LEDs from being mal-operated.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. An apparatus for driving a light emitting diode (LED), comprising:

a plurality of LED units, each LED unit formed of a plurality of LEDs serially connected to each other, the plurality of LED units connected to each other in parallel;

a rated current providing unit serially connected to the plurality of LED units, for providing a current to the plurality of LED units under control of a controller;

a voltage dividing unit connected between the plurality of LED units and another end of the rated current providing unit;

a voltage measuring unit connected to at least one of the plurality of LED units in parallel, for measuring a voltage applied to the at least one of the plurality of LED units; and at least one supplementary resistor formed between the at least one of the plurality of LED units and the voltage dividing unit, wherein a resistance value of the supplementary resistor is set based on the voltage measured by the voltage measuring unit.

2. The apparatus of claim 1, wherein the supplementary resistor is implemented as a variable resistor.

3. The apparatus of claim 1, wherein the rated current providing unit controls an amount of current applied to the LED unit based on a voltage measured by the voltage measuring unit under control of the controller.

4. The apparatus of claim 1, wherein the voltage dividing unit is implemented as a PTC (Positive Temperature Coefficient) thermistor.

5. The apparatus of claim 1, wherein when a current applied to the LED unit is larger than a preset reference value, a current applied to the LED unit is cut-off or is decreased by a preset value by the voltage dividing unit.

6. The apparatus of claim 1, wherein the voltage measuring unit measures each voltage applied to the plurality of LEDs.

7. An apparatus for driving a light emitting diode, comprising:

a rated current providing unit for controlling an amount of current applied to a plurality of LED units under control of a controller, the plurality of LED units connected to one another in parallel;

a voltage dividing unit connected between the plurality of LED units and the rated current providing unit, for dividing a voltage;

a voltage measuring unit connected to at least one of the plurality of LED units in parallel, for measuring a voltage applied to at least one of the plurality of LED units; and at least one supplementary resistor formed between the at least one of the plurality of LED units and the voltage dividing unit, wherein a resistance value of the supplementary resistor is set based on the voltage measured by the voltage measuring unit.

8. The apparatus of claim 7, wherein the rated current providing unit controls an amount of current applied to the LED unit based on a voltage measured by the voltage measuring unit under control of the controller.

9. The apparatus of claim 7, wherein when a current applied to the LED unit is larger than a preset reference value, a current applied to the LED unit is cut-off or is decreased by a preset value by the voltage dividing unit.

10. An apparatus for driving a light emitting diode (LED), comprising:

a plurality of LED units, each LED unit formed of a plurality of LEDs serially connected to each other, the plurality of LED units connected to one another in parallel;

a rated current providing unit connected to one end of the plurality of LED units, for providing a current to the plurality of LED units;

a voltage dividing unit connected between another end of the plurality of LED units and another end of the rated current providing unit;

a voltage measuring unit connected to at least one of the plurality of LED units in parallel, for measuring a voltage applied to the at least one of the plurality of LED units;

a controller for controlling an amount of current applied to the plurality of LED units by adjusting an amount of current outputted from the rated current providing unit based on a voltage measured by the voltage measuring unit; and at least one supplementary resistor formed between the at least one of the plurality of LED units and the voltage dividing unit, wherein a resistance value of the supplementary resistor is set based on the voltage measured by the voltage measuring unit.

* * * * *